US005693597A

United States Patent [19]

Delfort et al.

[11] Patent Number: 5,693,597

[45] Date of Patent: Dec. 2, 1997

[54] COLLOIDAL ALKALINE OR ALKALINE-EARTH CARBONATES CONTAINING A COMPOUND OF CALCIUM, PHOSPHORUS AND SULPHUR IN MICELLAR FORM

[75] Inventors: Bruno Delfort, Paris; Bertrand Daoudal, Pontigny; Thierry Lacome, Rueil Malmaison; Françoise Dixmier, Sceaux; Maurice Born, Nanterre, all of France

[73] Assignee: Institut Francais du Petrole, Rueil Malmaison cedex

[21] Appl. No.: 634,821

[22] Filed: Apr. 19, 1996

[30] Foreign Application Priority Data

Apr. 20, 1995 [FR] France ..... 95 04863

[51] Int. Cl.[6] ..... C01M 159/12; C01M 135/10

[52] U.S. Cl. ..... 508/393; 508/392; 508/433

[58] Field of Search ..... 508/392, 393, 508/433

[56] References Cited

U.S. PATENT DOCUMENTS

| | | | |
|---|---|---|---|
| 3,655,558 | 4/1972 | Geyer et al. | 508/393 |
| 3,766,067 | 10/1973 | Mc Millen | 508/393 |
| 5,080,812 | 1/1992 | Parc et al. | 508/393 |
| 5,213,697 | 5/1993 | Vinci et al. | 508/393 |
| 5,468,399 | 11/1995 | Delfort et al. | 508/197 |

FOREIGN PATENT DOCUMENTS

| | | |
|---|---|---|
| 0 598 646 | 5/1994 | European Pat. Off. . |
| 2074723 | 10/1971 | France . |

*Primary Examiner*—Jacqueline V. Howard

*Attorney, Agent, or Firm*—Millen, White, Zelano & Branigan, P.C.

[57] ABSTRACT

Colloidal products are described which comprise micelles of alkaline metals or alkaline-earth metals, held in the colloidal state by at least one alkaline metal or alkaline-earth metal alkyl- or alkylarylsulphonate. The products further comprise micelles of a product containing calcium, phosphorus and sulphur resulting from the in situ reaction of calcium oxide or calcium hydroxide with a phosphorus sulphide, in particular tetraphosphorus decasulphide, and water.

These colloidal products are used as antiwear and extreme pressure additives for lubricating greases and oils.

19 Claims, No Drawings

COLLOIDAL ALKALINE OR ALKALINE-EARTH CARBONATES CONTAINING A COMPOUND OF CALCIUM, PHOSPHORUS AND SULPHUR IN MICELLAR FORM

SUMMARY OF THE INVENTION

The present invention concerns colloidal hyperbasic sulphonate type products and their use as additives for lubricants.

Our prior art French patent FR-B-2 698 018 describes colloidal products obtained by micellization of the product of the reaction of calcium oxide or hydroxide with a phosphorus sulphide, such as tetraphosphorus decasulphide, and water, carried out in the presence of a surfactant such as an alkylarylsulphonic acid or a calcium salt of such an acid. In the present application, the colloidal products are not produced in the presence of a surfactant but in the presence of a pre-existing micelle.

We have discovered that it is possible to micellize the product of the reaction of calcium oxide or hydroxide with tetraphosphorus decasulphide and water within a pre-existing micelle of an alkaline or alkaline-earth carbonate stabilized by an alkaline or alkaline-earth metal alkyl- or alkylarylsulphonate (the latter being termed overbased or hyperbasic).

The products of the invention can generally be defined by the fact that they consist of colloidal products comprising micelles of alkaline or alkaline-earth metal carbonate held in the colloidal state by a surfactant consisting of at least one alkaline or alkaline-earth metal alkyl- or alkylarylsulphonate, and further comprising a product containing calcium, phosphorus and sulphur resulting from the in situ reaction of calcium oxide or hydroxide with a phosphorus sulphide, generally tetraphosphorus decasulphide, and water, held in the colloidal state by the surfactant of the pre-existing micelle. The structure of the product corresponds to that of at least one calcium thiophosphate and/or at least one calcium polythiophosphate.

The starting materials for producing the products of the invention are alkaline or alkaline-earth alkylsulphonates or alkylarylsulphonates, for example of sodium, potassium, calcium or magnesium, overbased by an alkaline or alkaline-earth carbonate such as calcium, magnesium, sodium or potassium carbonate. Such alkylsulphonates and alkylarylsulphonates are derived from the corresponding acids which have been described in a number of documents, for example FR-B-2 101 813. The overbased alkyl- or alkylarylsulphonates used can have a basicity reserve of 50 to about 500 or more (total base number expressed in mg of potassium hydroxide per gram of product).

The phosphorus sulphide is normally tetraphosphorus decasulphide $P_4S_{10}$.

The reactants are dispersed calcium oxide or hydroxide, the phosphorus sulphide and water in the following proportions:

- the molar ratio of the calcium oxide or hydroxide to the phosphorus sulphide is 4/1 to 20/1;
- the molar ratio of the water to the phosphorus sulphide is 2/1 to 20/1; and
- the phosphorus sulphide is used in a proportion of 1 to 30 g per 100 g of overbased alkyl or alkylarylsulphonate.

At the beginning of the reaction, the overbased alkaline or alkaline-earth metal alkyl- or alkylarylsulphonate is a colloidal solution in a solvent which may consist of an aliphatic hydrocarbon (such as a hexane, heptane or octane); an aromatic hydrocarbon (such as toluene or a xylene); a cycloaliphatic hydrocarbon (such as cyclohexane); a chlorinated hydrocarbon (such as mono- or dichlorobenzene); or an ether (such as tetrahydrofuran).

A diluting oil may be used which consists of a mineral or synthetic oil such as a lubricating oil, which may contain one of the solvents mentioned above.

The reaction temperature is generally from ambient temperature to 170° C., more particularly the reflux temperature of the selected solvent.

The products of the invention can be obtained by the process described above in the presence of an oil and thus usually contain 30% to 70% by weight of active material. They generally have a calcium content of up to 30% by weight; a sodium content of 5% to 30% by weight when the starting substrate is colloidal sodium carbonate; a phosphorus content of 0.5% to 10% by weight and a sulphur content of 1% to 20% by weight.

The micelle core contains the starting alkaline or alkaline-earth carbonate and an additional quantity of the micellized calcium, phosphorus and sulphur compound, probably in the form of calcium thiophosphate.

It should be noted at this point that our prior art patent FR-B-2 698 019 has already described the modification of calcium or magnesium carbonate micelles by the product of the reaction between tetraphosphorus decasulphide and water. In this case, the acid formed—probably thiophosphoric acid—reacted with the colloidal calcium or magnesium carbonate present.

In the present application, however, the thiophosphoric acid formed preferentially reacts with the added calcium oxide or hydroxide without consuming the basicity reserve of alkaline or alkaline-earth carbonate which has already been micellized. This reaction mode has been confirmed by analyzing the calcium content before and after reaction, also by determining the total base number, which is unaffected by the reaction.

The colloidal nature of the products of the invention has been verified by dialysis through a latex membrane. Analyses of the sulphur and/or phosphorus located these elements in the fraction which did not dialyses (concentrate), which constitutes the colloidal portion of the additive. The colloidal products of the invention retain the known detergent properties of the overbased starting products from which they are derived.

They also exhibit antiwear and extreme-pressure properties. Antiwear and extreme-pressure additives are incorporated into lubricants when they are intended to lubricate objects which are subjected to large mechanical stresses, such as timing gear in heat engines, gears, rolling bearings or thrust bearings. Large mechanical stresses also occur when metal is machined, either by cutting or forming.

The colloidal products of the invention have high thermal stability, which means that they can be used in lubricants which are employed at very high temperatures of up to 200° C., for example in some heavy engine casings, in highly loaded transmissions or for high speed metal cutting.

When using the products of the invention as additives for greases and lubricating oils, they can for example be incorporated at a concentration of 0.1% to 25% by weight, preferably 1% to 15% by weight.

The lubricating oils (or greases) also generally contain one or more additives such as viscosity index improvers, additives which reduce the pour point, anti-oxidants, rust inhibitors, copper corrosion inhibitors, detergents, antiwear additives, antifoaming additives, dispersing agents, or friction reducing agents, with which the products of the invention are compatible.

EXAMPLES

The following examples illustrate the invention without limiting its scope.

In Examples 1 to 5, the products of the invention were produced from colloidal substrates consisting of hyperbasic calcium or sodium alkylarylsulphonates A, B and C, whose alkaline reserve was essentially constituted by calcium carbonate and sodium carbonate respectively. They had the following characteristics:

| Substrate | Alkaline reserve | TBN (1) | Active Material (2)(weight %) | Oil (2) (weight %) | Ca or Na (weight %) | S (weight %) |
|---|---|---|---|---|---|---|
| A | $CaCO_3$ | 300 | 59 | 41 | 11.6 | 1.8 |
| B | $CaCO_3$ | 500 | 61.8 | 38.2 | 18.6 | 1.3 |
| C | $Na_2CO_3$ | 377 | 59.1 | 40.9 | 15.7 | 1.8 |

(1) Total base number expressed in mg of potassium per g of product (ASTM D 2896);
(2) Determined by dialysis.

Example 1

50 g of hyperbasic calcium sulphonate A dissolved in 250 ml of xylene and 50 ml of tetrahydrofuran were introduced into a reactor. 6 g (0.0135 mole) of tetraphosphorus decasulphide and 15 g (0.267 mole) of calcium CaO were dispersed in it. A solution of 4.9 g of water in 50 ml of tetrahydrofuran was introduced over one hour at 30° C. with constant stirring. The medium was stirred for 3 hours, then the tetrahydrofuran and excess water were eliminated by distillation. After cooling to ambient temperature, the medium was filtered and the filtrate was evaporated under reduced pressure. A homogeneous liquid product was obtained which had the following concentrations by weight:

Ca=14.7%
P=2.3%
S=6.2%

Example 2

50 g of hyperbasic calcium sulphonate A dissolved in 250 ml of xylene, 30 g of 130 Neutral oil and 50 ml of tetrahydrofuran were introduced into a reactor. 10g (0.0225 mole) of tetraphosphorus decasulphide and 20 g (0.357 mole) of calcium oxide CaO were dispersed in it. A solution of 8.1 g of water in 50 ml of tetrahydrofuran was introduced over one hour at 30° C. with constant stirring. The medium was stirred for 3 hours, then the tetrahydrofuran and excess water were eliminated by distillation. After cooling to ambient temperature, the medium was filtered and the filtrate was evaporated under reduced pressure. A homogeneous liquid product was obtained which had the following concentrations by weight:

Ca=11.3%
P=2.4%
S=6.4%

Example 3

50 g of hyperbasic calcium sulphonate B dissolved in 250 ml of xylene and 50 ml of tetrahydrofuran were introduced into a reactor. 5 g (0.0113 mole) of tetraphosphorus decasulphide and 20 g (0.27 mole) of $Ca(OH)_2$ were dispersed in it. A solution of 4.1 g of water in 50 ml of tetrahydrofuran was introduced over one hour at 30° C. with constant stirring. The medium was stirred for 3 hours, then the tetrahydrofuran and excess water were eliminated by distillation. After cooling to ambient temperature, the medium was filtered and the filtrate was evaporated under reduced pressure. A homogeneous liquid product was obtained which had the following concentrations by weight:

Ca=21.1%
P=1.9%
S=5.7%

Example 4

50 g of hyperbasic calcium sulphonate B dissolved in 250 ml of xylene and 50 ml of tetrahydrofuran were introduced into a reactor. 6 g (0.0135 mole) of tetraphosphorus decasulphide and 20 g (0.357 mole) of CaO were dispersed in it. A solution of 4.9 g of water in 50 ml of tetrahydrofuran was introduced over one hour at 30° C. with constant stirring. The medium was stirred for 3 hours, then the tetrahydrofuran and excess water were eliminated by distillation. After cooling to ambient temperature, the medium was filtered and the filtrate was evaporated under reduced pressure. A homogeneous liquid product was obtained which had the following concentrations by weight:

Ca=22.3%
P=2.4%
S =6.7%

Example 5

50 g of hyperbasic sodium sulphonate C dissolved in 250 ml of xylene and 50 ml of tetrahydrofuran were introduced into a reactor. 4 g (0.009 mole) of tetraphosphorus decasulphide and 20 g (0.357 mole) of calcium oxide CaO were dispersed in it. A solution of 3.2 g of water in 50 ml of tetrahydrofurane was introduced over one hour at 30° C. with constant stirring. The medium was stirred for 3 hours, then the tetrahydrofurane and excess water were eliminated by distillation. After cooling to ambient temperature, the medium was filtered and the filtrate was evaporated under reduced pressure. A homogeneous liquid product was obtained which had the following concentrations by weight:

Na=15.6%
Ca=1.3%
P=1.4%
S=3.9%

Example 6

Examination of Products By Dialysis

The products of Examples 1 to 5 were dialysed in n-heptane through a latex membrane. The non colloidal fraction (diluting oil), termed the dialyzate, dialyzed through the membrane while the colloidal fraction, termed the concentrate, was retained within the membrane. The fact that the calcium, sodium, phosphorus and sulphur was localised in the non dialysed fraction confirmed the colloidal nature of the products of the invention. The calcium concentration in the active material was greater in each of the modified products than in its precursor. This confirmed that additional calcium had been incorporated into the micelle, the calcium coming from the dispersed calcium oxide or hydroxide present during synthesis.

The results are shown in Table 1.

TABLE 1

| product | CONCENTRATE (weight %) | | | | | DIALYZATE (weight %) | | | | |
|---|---|---|---|---|---|---|---|---|---|---|
| from ex | % | Ca | Na | S | P | % | Ca | Na | S | P |
| 1 | 63.4 | 23.5 | | 9.3 | 3.7 | 36.6 | 0 | | 0.7 | 0 |
| 2 | 45.2 | 26.0 | | 14.3 | 5.6 | 54.8 | 0 | | 0.6 | 0 |
| 3 | 62.0 | 33.8 | | 8.6 | 2.9 | 38.0 | 0 | | 0.6 | 0 |
| 4 | 64.0 | 34.2 | | 10.7 | 3.9 | 36.0 | 0 | | 0.5 | 0 |
| 5 | 63.0 | 1.9 | 24.6 | 6.0 | 2.4 | 37.0 | 0 | 0 | 0.4 | 0 |
| A | 59.0 | 20.9 | | 3.0 | | 41.0 | | | 0.4 | |
| B | 61.8 | 30.1 | | 2.2 | | 38.2 | | | 0.1 | |
| C | 59.1 | | 25.6 | 2.6 | | 40.9 | | 0 | 0.4 | |

Example 7

Evaluation of Antiwear and Extreme-Pressure Performances

The products of the invention, prepared as described in Examples 1 to 5 above, were characterized by their antiwear and extreme-pressure properties in 130 Neutral mineral oil solvent at a concentration which allowed adjustment of the concentration of active material to 7.5% by weight. Characterization was carried out using a 4 ball tester, in accordance with ASTM D2783. The results are shown in Table 2, which also shows the results obtained with unmodified hyperbasic sulphonates A, B and C evaluated at the same concentration. The results confirm the better antiwear and extreme-pressure performances of the products of the invention (products from Examples 1 and 2 compared with A, from Examples 3 and 4 compared with B, and Example 5 compared with C) .

We claim:

1. A colloidal product comprising:

micelles of at least one alkaline metal carbonate, at least one alkaline-earth metal carbonate, or a combination thereof, held in colloidal state by at least one surfactant selected from alkaline or alkaline-earth metal alkyl- or alkylarylsulphonate; and a product containing calcium, phosphorus and sulphur resulting from the in situ reaction of calcium oxide or hydroxide with a phosphorus sulphide and water, held in the colloidal state, in the form of micelles, by said surfactant of the pre-existing micelles;

wherein the structure of said product containing calcium, phosphorus and sulfur corresponds to that of at least one calcium thiophosphate, at least one calcium polythiophosphate, or a combination thereof.

2. A colloidal product according to claim 1, wherein said micelles are of sodium, potassium, calcium or magnesium carbonate held in the colloidal state by a sodium, potassium, calcium or magnesium alkylsulphonate or alkylarylsulphonate.

3. A colloidal product according to claim 1, wherein said alkaline or alkaline-earth metal alkylsulphonate or alkylaryl sulphonate has a basicity reserve of about 50 to 500 mg of potassium hydroxide per gram.

4. A colloidal product according to claim 1, wherein said phosphorus sulphide is tetraphosphorus decasulphide.

5. A colloidal product according to claim 1, wherein the in situ product containing calcium, phosphorus and sulphur is effected by addition to pre-existing micelles of: 1–30 g phosphorus sulphide per 100 g of alkylsulphonate or alkylarylsulphonate; 4–20 moles of calcium oxide or calcium hydroxide per mole of phosphorus sulphide; and 20–20 moles of water per mole of phosphorus sulphide.

6. A colloidal product according to claim 1, wherein said in situ reaction is carried out in a solvent selected from an aliphatic, aromatic or cycloaliphatic hydrocarbon; a chlorinated hydrocarbon; an ether: a diluting oil; and combinations thereof, at a temperature which is between ambient temperature and 170° C.

7. A colloidal product according to claim 1, wherein said colloidal product is in the form of a diluting oil containing 30%–70% by weight of active material.

8. A colloidal product according to claim 1, wherein said colloidal product contains up to 30% by weight of calcium, optionally 5%–30% by weight of sodium, 0.5%–10% by weight of phosphorus and 1%–20% by weight of sulphur.

9. A method comprising adding colloidal product according to claim 1 as an additive with detergent action and/or an antiwear or extreme-pressure action to a lubricating grease or oil.

10. In a lubricating grease or oil composition, the improvement wherein said grease or oil composition contains 0.1%–25% by weight of at least one colloidal product according to claim 1.

11. A lubricating grease or oil composition according to claim 10, characterized in that said colloidal product is incorporated at a concentration of 1% to 15% by weight.

12. A colloidal product according to claim 2, wherein wherein said alkaline or alkaline-earth metal alkylsulphonate or alkylarylsulfonate has a basicity reserve of about 50 to 500 mg of potassium hydroxide per gram.

13. A colloidal product according to claim 12, wherein said phosphorus sulfide is tetraphosphorus decasulfide.

14. A colloidal product according to claim 13, wherein the in situ product containing calcium, phosphorus and sulfur is effected by addition to said pre-existing micelles of: 1–30 phosphorus sulfide per 100 g of alkylsulfonate or alkylarylsulfonate; 4–20 moles calcium oxide or hydroxide per mole of phosphorus sulfide; and 2–20 moles water per mole of phosphorus sulfide.

15. A colloidal product according to claim 14, wherein said in situ reaction is carried out in a solvent selected from an aliphatic, aromatic or cycloaliphatic hydrocarbon; a chlorinated hydrocarbon; an ether; a diluting oil; and combinations thereof, at a temperature which is between ambient temperature and 170° C.

16. A colloidal product according to claim 15, wherein said colloidal product is in the form of a diluting oil containing 30%–70% by weight of active material.

17. A colloidal product according to claim 16, wherein said colloidal product contains up to 30% by weight of calcium, optionally 5%–30% by weight of sodium, 0.5%–10% by weight of phosphorus and 1%–20% by weight of sulfur.

18. A colloidal product prepared by a process comprising:

preparing, in a solvent, micelles of at least one alkaline metal carbonate, at least one alkaline-earth metal carbonate, or a combination thereof, held in colloidal state by a surfactant selected from an alkaline alkylsulfonate, an alkaline alkylarylsulfonate, an alkaline-earth metal alkylsulfonate, an alkaline-earth metal alkylarylsulfonate, or a combination thereof, to form a colloidal solution;

reacting within said colloidal solution calcium oxide or calcium hydroxide with a phosphorus sulfide and water, whereby the product of the reaction is held in colloidal state by said surfactant.

19. A colloidal product comprising:

micelles of at least one alkaline metal carbonate, at least one alkaline-earth metal carbonate, or a combination thereof, held in colloidal state by a surfactant selected from an alkaline metal alkylsulfonate, an alkaline metal alkylarylsulfonate, an alkaline-earth metal alkylsulfonate, an alkaline-earth metal alkylarylsulfonate, or a combination thereof, said micelles further containing the product derived from an in situ reaction of calcium oxide or calcium hydroxide with a phosphorus sulfide and water.

* * * * *